US010760152B2

(12) United States Patent
Kawakami et al.

(10) Patent No.: US 10,760,152 B2
(45) Date of Patent: Sep. 1, 2020

(54) TITANIUM ALLOY HAVING HIGH STRENGTH, HIGH YOUNG'S MODULUS, EXCELLENT FATIGUE PROPERTIES, AND EXCELLENT IMPACT TOUGHNESS

(71) Applicant: NIPPON STEEL & SUMITOMO METAL CORPORATION, Tokyo (JP)

(72) Inventors: Akira Kawakami, Tokyo (JP); Hideki Fujii, Tokyo (JP); Kenichi Mori, Tokyo (JP); Tomoyuki Kitaura, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 20 days.

(21) Appl. No.: 15/522,916

(22) PCT Filed: Nov. 28, 2014

(86) PCT No.: PCT/JP2014/081614
§ 371 (c)(1),
(2) Date: Apr. 28, 2017

(87) PCT Pub. No.: WO2016/084243
PCT Pub. Date: Jun. 2, 2016

(65) Prior Publication Data

US 2017/0321312 A1 Nov. 9, 2017

(51) Int. Cl.
*C22F 1/18* (2006.01)
*C22C 14/00* (2006.01)
*C22F 1/00* (2006.01)

(52) U.S. Cl.
CPC ..... *C22F 1/183* (2013.01); *C22C 14/00* (2013.01); *C22F 1/00* (2013.01); *C22F 1/18* (2013.01)

(58) Field of Classification Search
CPC .... C22C 14/00; C22F 1/00; C22F 1/18; C22F 1/183
See application file for complete search history.

(56) References Cited

U.S. PATENT DOCUMENTS

2006/0172819 A1 8/2006 Sano
2013/0327448 A1 12/2013 Kawakami et al.
2015/0292650 A1 10/2015 Kawakami et al.

FOREIGN PATENT DOCUMENTS

CN 103348029 A * 10/2013 ..... C22C 14/00
CN 103403203 A 11/2013
(Continued)

OTHER PUBLICATIONS

International Search Report (PCT/ISA/210) issued in PCT/JP2014/081614, dated Feb. 3, 2015.
(Continued)

*Primary Examiner* — Jenny R Wu
(74) *Attorney, Agent, or Firm* — Birch, Stewart, Kolasch & Birch, LLP

(57) ABSTRACT

Provided is an α+β titanium alloy hot-rolled sheet consisting of, in mass %, Al: 4.7 to 5.5%, Fe: 0.5 to 1.4%, N: less than or equal to 0.03%, Si: 0.15 to 0.40%, a ratio of Si/O: 0.80 to 2.80, $[O]_{eq}$ in Expression (1): more than or equal to 0.13% and less than 0.25%, and the balance: Ti and impurities. In a case where an ND direction represents a normal direction of the hot-rolled sheet, a TD direction represents a sheet-width direction of the hot-rolled sheet, a c-axis orientation represents a normal direction of a (0001) plane in an α phase, XND represents a strongest intensity among X-ray (0002) reflection relative intensities of crystal grains in which the c-axis orientation is in a range of 30° from the ND direction, and XTD represents a strongest intensity among intensities in which the c-axis orientation is in a range of ±10 degrees in the TD direction, XTD/XND is more than or equal to 4.0, a Young's modulus in the sheet-width direction is more than or equal to 135 GPa, and tensile strength in the sheet-width direction is more than or equal to 1100 MPa, $$[O]_{eq}=[O]+2.77[N] \quad \text{Expression (1).}$$

2 Claims, 2 Drawing Sheets

(56) References Cited

FOREIGN PATENT DOCUMENTS

| | | | |
|---|---|---|---|
| EP | 2 674 506 | A1 | 12/2013 |
| EP | 2 801 631 | A1 | 11/2014 |
| JP | 7-062474 | A | 3/1995 |
| JP | 11-343529 | A | 12/1999 |
| JP | 2004-010963 | A | 1/2004 |
| JP | 2005-220388 | A | 8/2005 |
| JP | 2006-212092 | A | 8/2006 |
| JP | 2012-132057 | A | 7/2012 |
| JP | 2012-149283 | A | 8/2012 |
| JP | 2014-224301 | A | 12/2014 |
| WO | WO 2012/108319 | A1 | 8/2012 |
| WO | WO 2012/115243 | A1 | 8/2012 |
| WO | WO 2013/094647 | A1 | 6/2013 |

OTHER PUBLICATIONS

Kikukawa et al., "Measurement of Fatigue Crack Propagation and Crack Closure at Low Stress Intensity Level by Unloading Elastic Compliance Method", Journal of the Society of Materials Science, Japan, vol. 25, No. 276, 1976, pp. 899-903.

Written Opinion (PCT/ISA/237) issued in PCT/JP2014/081614, dated Feb. 3, 2015.

First Office Action dated Feb. 5, 2018, in Chinese Patent Application No. 201480083551.7, with partial English translation.

* cited by examiner

REGIONS CORRESPONDING TO FIG. 1(b) AND (c) IN (0001)
POLE FIGURE OF TITANIUM α PHASE

TITANIUM ALLOY HAVING HIGH STRENGTH, HIGH YOUNG'S MODULUS, EXCELLENT FATIGUE PROPERTIES, AND EXCELLENT IMPACT TOUGHNESS

TECHNICAL FIELD

The present invention relates to a titanium alloy sheet which has high strength and a high Young's modulus in one direction in a plane of the sheet, and is excellent in fatigue properties and/or impact toughness, and which also has satisfactory hot workability.

BACKGROUND ART

Using excellent properties such as high specific strength and high corrosion resistance, many titanium alloy products have been used as, for example, aircraft construction materials. Meanwhile, for use as consumer products, the titanium alloy products have been widely used as muffler members for automobiles/motorcycles, glasses frames, sports tools (such as golf club faces, parts for spikes, and metal bats), and the like.

As one of defects of the titanium alloy, there is given that the Young's modulus is lower than the Young's modulus of a steel material and the like. With a low Young's modulus, there is a problem in that elastic deformation likely occurs (rigidity is low) in the case where the titanium alloy is used as structural materials and parts. Further, in the case where the titanium alloy is used as a golf club face, for example, since the face is likely to deflect, a coefficient of restitution is apt to be large, and there is a problem in that it is difficult to satisfy a coefficient-of-restitution regulation.

In this case, in the case where the shape of a product is an elliptic or rectangular sheet, it is already known that a high Young's modulus in the short-side direction makes the deflection less likely to occur, and is effective as means to increase the rigidity of the sheet. In order to obtain such a state, Patent Literature 1 discloses technology for increasing the strength and the Young's modulus in the sheet-width direction by performing unidirectional hot-rolling on an $\alpha+\beta$ titanium alloy and controlling the texture. In this technology, an $\alpha+\beta$ alloy is subjected to unidirectional hot-rolling under specific conditions to develop a hot-rolling texture that is called transverse-texture in which a basal plane of a titanium $\alpha$ phase is strongly orientated in the sheet-width direction, and thus, the strength and the Young's modulus in the sheet-width direction are increased. In this case, it becomes possible to make it difficult to deflect an elliptic or rectangular sheet-like product by setting the sheet-width direction of the hot-rolled sheet to the short-side of the sheet-like product.

In this manner, for use as golf club faces, for example, application of $\alpha+\beta$ titanium alloys each having a high Young's modulus is the mainstream under the environment in which the coefficient-of-restitution regulation has become strict. With the use of an $\alpha+\beta$ titanium alloy having a high Young's modulus, the coefficient of restitution hardly increases even if the thickness of the face decreases, and the degree of freedom of the sheet thickness for clearing the coefficient-of-restitution regulation increases compared to a $\beta$ titanium alloy having a low Young's modulus. Further, there are many advantages in that, compared to the $\beta$ titanium alloy, the $\alpha+\beta$ titanium alloy is smaller in specific gravity so that the volume of a club head can be increased with the same mass, and is also smaller in content of expensive alloying elements so that the cost of materials is low. As the $\alpha+\beta$ titanium alloy, Ti-6% Al-4% V is typically used, and in addition, examples of the $\alpha+\beta$ titanium alloy also include Ti-5% Al-1% Fe, Ti-4.5% Al-3% V-2% Fe-2% Mo, Ti-4.5% Al-2% Mo-1.6% V-0.5Fe-0.3% Si-0.03% C, Ti-6% Al-6% V-2% Sn, Ti-6% Al-2% Sn-4% Zr-6% Mo, and Ti-8% Al-1% Mo-1% V, Ti-6% Al-1% Fe.

Moreover, for use as golf club faces, it is desirable that a thin-sheet material or the like in which molding processability at the time of processing a face is low and freedom in meeting the coefficient-of-restitution regulation with shape control is low have a Young's modulus in one direction in the plane of the sheet of more than or equal to 135 GPa and tensile strength of more than or equal to 1100 MPa. In this case, it is desirable that the Young's modulus satisfy the above value in order to clear the coefficient-of-restitution regulation, and it is desirable that the tensile strength and ductility satisfy the above value in order to obtain satisfactory fatigue properties. However, in general, processability of an $\alpha+\beta$ alloy is not satisfactory, and even if the sheet thickness is decreased, there are few alloys which have excellent fatigue properties, high strength and a high Young's modulus that satisfy the coefficient-of-restitution regulation, and satisfactory hot workability. Further, high values in fatigue properties and/or impact toughness have not been achieved yet, which influence durability of golf club faces. That is, no technology has been disclosed yet which relates to a titanium alloy having a high Young's modulus and high fatigue strength and/or impact toughness.

Further, oxygen contained in a titanium alloy is known as an element that is likely to segregate at the time of manufacturing an ingot, and, although a titanium alloy containing a large amount of oxygen has high strength, there is a problem in that different concentrations caused strength variation within an ingot. In addition, there is also a problem in that when oxygen is contained excessively, the ductility decreases considerably.

For example, Ti-6% Al-4% V alloy, which is a most general-purpose $\alpha+\beta$ alloy, has sufficient strength and Young's modulus, and is already used widely as structural members such as aircraft construction material parts. However, this alloy has problems in that: the alloy contains 6% of Al, which has a high solid-solution-strengthening ability and increases deformation resistance at the time of hot working, and the hot workability is not satisfactory; the alloy contains 4% of V, which is an expensive $\beta$ stabilizer element, and the cost of the material is relatively high; and the alloy is strengthened by solid-solution-strengthening owing to O, as will be described later, and hence, the fatigue strength is not sufficient.

Patent Literature 2 discloses a low-cost alloy having high specific strength in the same manner as Ti-6% Al-4% V alloy. This is an $\alpha+\beta$ alloy aiming at gaining high specific strength and low cost by adding a large amount of Al which is an a stabilizer element having low specific gravity. However, this alloy contains 5.5 to 7% of Al, and has a disadvantage in that it is difficult to be subjected to hot working. In order to lower the processing cost for the face material, a supply of a sheet product that can be processed into a face shape only through easy press forming and polishing steps is desired. In manufacturing a hot-rolled sheet of the alloy, however, the range of the appropriate hot-rolling temperature is small due to high hot deformation resistance, and even if the temperature is slightly lower than the range, edge cracking easily occurs to cause a problem of a decrease in production yield. Further, strength variation due to segregation of oxygen is also present.

Patent Literature 3 discloses a golf club head including a high strength and low resilience titanium alloy face. It defines the contents of Al and Fe in the titanium alloy for forming the face, and describes that therefore a high Young's modulus and tensile strength can be obtained. Although Patent Literature 3 does not describe a specific method of manufacturing the alloy, the manufacturing method is limited to some extent in order to obtain tensile strength of 1200 to 1600 MPa as recited in Claims in the alloy composition containing Al, Fe, and the balance of inevitable impurities as shown in Claims. That is, such strength cannot be obtained in the case of as-hot worked such as hot-rolling and forging, or in the case of performing annealing treatment after hot working or cold working. In addition, a product in this strength range cannot be obtained also in the case of subjecting a hot- or cold-worked product to aging heat treatment, but may be obtained only in a state of as-cold worked which is processed up to a high processing degree. However, when the as-cold worked material is used for a golf club face, high strength can be obtained but fatigue properties decrease remarkably, therefore, once a fatigue crack occurs on the face, the propagation of the fatigue crack cannot be stopped. Thus, there is a problem in that excellent fatigue properties necessary for golf club faces cannot be ensured.

Patent Literature 4 discloses a titanium alloy sheet for a face in which fatigue properties of a heat-affected zone in a golf club head including a weld zone are high, and in which a Young's modulus and strength are adjustable by heat treatment. It is characterized in that addition of appropriate amounts of Al, Fe, O, and N adjusts the strength and enhances the fatigue properties of the heat-affected zone, and control on heat treatment conditions such as aging strengthening heat treatment controls the Young's modulus. However, after Patent Literature 4 was filed, the coefficient-of-restitution regulation was introduced and only alloys with a high Young's modulus have been demanded. With the sheet product manufactured with the alloy composition under the manufacturing conditions recited in Claims of Patent Literature 4, there is the problem in that sometimes a high Young's modulus which satisfies the coefficient-of-restitution regulation cannot be obtained. Further, strength variation due to segregation of oxygen similar to that written in Patent Literature 2 is also present.

Patent Literature 5 discloses technology for enhancing coil handleability during cold working, for example, the technology includes subjecting a titanium alloy containing Al, Fe, O, and N to unidirectional hot-rolling and developing the above-mentioned texture called transverse-texture, to thereby suppress occurrence of fracture in the sheet during coil winding. With the development of the transverse-texture, even if edge cracking to be the starting point of the sheet fracture occurs, the crack propagates obliquely and the length of the crack increases. However, no consideration is given to solve the technical problems of a high Young's modulus, high fatigue properties, strength ununiformity, and the like.

Moreover, Patent Literature 6 discloses an α+β titanium alloy containing Al, Fe, and Si, and discloses that the α+β titanium alloy has the same fatigue strength and creep resistance as a conventional Al—Fe-based titanium alloy. However, no consideration is given to the technical problems on the high Young's modulus, strength ununiformity, and the like.

Patent Literature 7 discloses a method of manufacturing an α+β titanium alloy, the method including: heating a titanium alloy containing Al, Fe, Si, and O, and further containing selectively Mo and V to a temperature higher than or equal to a β transus temperature, starting hot-rolling at lower than or equal to the β transus point, and performing hot-rolling mainly at higher than or equal to 900° C. Although it is written that the thus manufactured titanium alloy can decrease surface flaws that occur on the surface of the hot-rolled sheet, there is no disclosure of technology related to a titanium alloy having a high Young's modulus, high strength, excellent fatigue properties, and uniform strength.

Patent Literature 8 discloses a near-β α+β alloy to which Si is added and which is excellent in fracture toughness, and a manufacturing method thereof. However, the toughness is evaluated with fracture toughness values, not with a property related to impact toughness including deformation under a high rate of strain determined by a Charpy test or the like. Further, the microstructure is limited to an acicular structure.

Here, the fracture toughness is generally a material property indicating the ability of a material to resist crack propagation under a relatively low rate of strain, and is generally evaluated by performing a fracture toughness test. For example, the evaluation may be performed using Unloading Elastic Compliance Method shown in Non-Patent Literature 1. On the other hand, the impact toughness is a property indicating the ability of a material to resist fracture under a high rate of strain, and can be evaluated easily by using absorbed energy of the Charpy impact test. Since golf clubs and automobile parts are exposed to deformation at a high rate, it is desired that the impact toughness be high.

That is, no technology has been disclosed yet, which relates to an α+β titanium alloy satisfying simultaneously a high Young's modulus, high strength, excellent fatigue properties, and excellent impact toughness, which are required for high-grade golf club faces or some automobile parts. Further, technology taking into consideration strength variation due to segregation of oxygen within an ingot has also not been disclosed yet.

CITATION LIST

Patent Literature

Patent Literature 1: JP 2012-132057A
Patent Literature 2: JP 2004-10963A
Patent Literature 3: JP 2006-212092A
Patent Literature 4: JP 2005-220388A
Patent Literature 5: WO 2012/115243A1
Patent Literature 6: JP H7-62474A
Patent Literature 7: JP 2012-149283A
Patent Literature 8: JP H11-343529A

Non-Patent Literature

Non-Patent Literature 1: "Journal of the Society of Materials Science, Japan" Vol. 25, No. 276, September 1976, p. 91-95

SUMMARY OF INVENTION

Technical Problem

The present invention aims to solve the above-mentioned problems, and an object of the present invention is to provide an α+β titanium alloy having high strength and a high Young's modulus in one direction in a plane of the sheet, and also having high fatigue properties and/or impact toughness.

Solution to Problem

The inventors of the present invention have prevented a decrease in the Young's modulus by adding Al, O, and N, which act to solid-solution-strengthen the α phase, and Si, which shows an opposite segregation tendency to O, taking into account the balance between Si and O, selecting Fe as a β stabilizer element, Fe being inexpensive and having high β-stabilizing ability, and defining appropriately the amounts of addition of those elements, to thereby decrease the volume fraction of β phase at room temperature. Moreover, the inventors have found that high strength and a high Young's modulus in one direction in the plane of the sheet and uniform strength can be achieved by performing unidirectional hot-rolling on this alloy, without depending on cold working strengthening or aging strengthening heat treatment. At the same time, the inventors have also found that high strength is exhibited as well as high fatigue properties and/or impact toughness. Since Si shows an opposite segregation tendency to O, by adding Si and O in combination, controlling appropriately contents of Si and O, and setting the upper limit of oxygen in an appropriate range, it becomes possible to prevent excessively high strength and low ductility at a position at the top side of the original ingot, which are caused by solidification segregation of O in the case where O is added alone. Further, since Si shows an opposite segregation tendency to O and the contents of Si and O are appropriately controlled, it is characterized in that a portion having excessively high hardness is unlikely to be generated, the portion being a starting point of fracture or being a part in which the occurred crack easily propagates in a fatigue test and an impact test. In this manner, by adding appropriate amounts of Si and O taking into account their balance, the amounts being such that the fatigue properties and/or impact toughness are not adversely influenced, it becomes possible to ensure uniform strength in addition to the fatigue properties and impact toughness.

In particular, by subjecting this alloy to unidirectional hot-rolling and developing a texture called transverse-texture in which a c-axis in a titanium α phase is strongly orientated in the sheet-width direction, it is possible to increase the tensile strength and the Young's modulus in the sheet-width direction, and also to increase the fatigue properties and/or impact toughness in the case where bending deformation is repeated in the sheet-width direction. In particular, it has been found that, owing to the above-mentioned mechanism, the effects are high in the case where Si and O are added in combination and the balance between those elements are taken into account.

Further, this alloy has small specific gravity, and is an optimum material for a wide range of application including golf club faces. Moreover, this alloy has, compared to other α+β alloys mainly including Ti-6% Al-4% V alloy, a lower content of Al which lowers hot workability, lower hot-rolling load during hot-rolling, and less tendency to cause flaws and edge cracking during hot-rolling, and therefore has an advantage in that the manufacturability of products having various shapes including a thin sheet is satisfactory.

The present invention has been achieved on the basis of the above-mentioned findings, and the gist of the present invention is as follows.

(1) An α+β titanium alloy hot-rolled sheet having excellent hot workability, the α+β titanium alloy hot-rolled sheet consisting of, in mass %, Al: 4.7 to 5.5%, Fe: 0.5 to 1.4%, N: less than or equal to 0.03%, $[O]_{eq}$ calculated using Expression (1): more than or equal to 0.13% and less than 0.25%, Si: 0.15 to 0.40%, a ratio of Si/O: 0.80 to 2.80, and the balance: Ti and impurities, wherein, in a case where an ND direction represents a normal direction of a rolling surface of the hot-rolled sheet, an RD direction represents a hot-rolling direction of the hot-rolled sheet, a TD direction represents a sheet-width direction of the hot-rolled sheet, a c-axis orientation represents a normal direction of a (0001) plane in an α phase, θ represents an angle between the c-axis orientation and the ND direction, φ represents an angle between a plane including the c-axis orientation and the ND direction and a plane including the ND direction and the TD direction, XND represents a strongest intensity among X-ray (0002) reflection relative intensities of crystal grains in which the angle θ is more than or equal to 0 degree and less than or equal to 30 degrees and the angle φ is a whole circumference (−180 degrees to 180 degrees), and XTD represents a strongest intensity among X-ray (0002) reflection relative intensities of crystal grains in which the angle θ is more than or equal to 80 degrees and less than 100 degrees and the angle φ is within ±10 degrees, XTD/XND is more than or equal to 4.0, a Young's modulus in the sheet-width direction is more than or equal to 135 GPa, and tensile strength in the sheet-width direction is more than or equal to 1100 MPa, where the sheet-width direction represents a direction perpendicular to the hot-rolling direction in a plane of the sheet, $$[O]_{eq}=[O]+2.77[N] \quad \text{Expression (1)}$$

where [O] represents an oxygen concentration (mass %) and [N] represents a nitrogen concentration (mass %).

(2) An α+β titanium alloy hot-rolled sheet having excellent hot workability, the α+β titanium alloy hot-rolled sheet consisting of, in mass %, Al: 4.7 to 5.5%, Fe: 0.5 to 1.4%, N: less than or equal to 0.03%, $[O]_{eq}$ calculated using Expression (1): more than or equal to 0.13% and less than 0.25%, Si: 0.2 to 0.40%, a ratio of Si/O: 0.80 to 2.80, and the balance: Ti and impurities, wherein, in a case where an ND direction represents a normal direction of a rolling surface of the hot-rolled sheet, an RD direction represents a hot-rolling direction of the hot-rolled sheet, a TD direction represents a sheet-width direction of the hot-rolled sheet, a c-axis orientation represents a normal direction of a (0001) plane in an α phase, θ represents an angle between the c-axis orientation and the ND direction, φ represents an angle between a plane including the c-axis orientation and the ND direction and a plane including the ND direction and the TD direction, XND represents a strongest intensity among X-ray (0002) reflection relative intensities of crystal grains in which the angle θ is more than or equal to 0 degree and less than or equal to 30 degrees and the angle φ is a whole circumference (−180 degrees to 180 degrees), and XTD represents a strongest intensity among X-ray (0002) reflection relative intensities of crystal grains in which the angle θ is more than or equal to 80 degrees and less than 100 degrees and the angle φ is within ±10 degrees, XTD/XND is more than or equal to 4.0, a Young's modulus in the sheet-width direction is more than or equal to 135 GPa, and tensile strength in the sheet-width direction is more than or equal to 1100 MPa, where the sheet-width direction represents a direction perpendicular to the hot-rolling direction in a plane of the sheet, $$[O]_{eq}=[O]+2.77[N] \quad \text{Expression (1)}$$

where [O] represents an oxygen concentration (mass %) and [N] represents a nitrogen concentration (mass %).

Advantageous Effects of Invention

According to the present invention, the α+β titanium alloy sheet can be provided, which has a high balance between strength and ductility and a high Young's modulus in the sheet-width direction, and is also excellent in fatigue properties and/or impact toughness, and strength uniformity.

DESCRIPTION OF EMBODIMENTS

Figure 1:
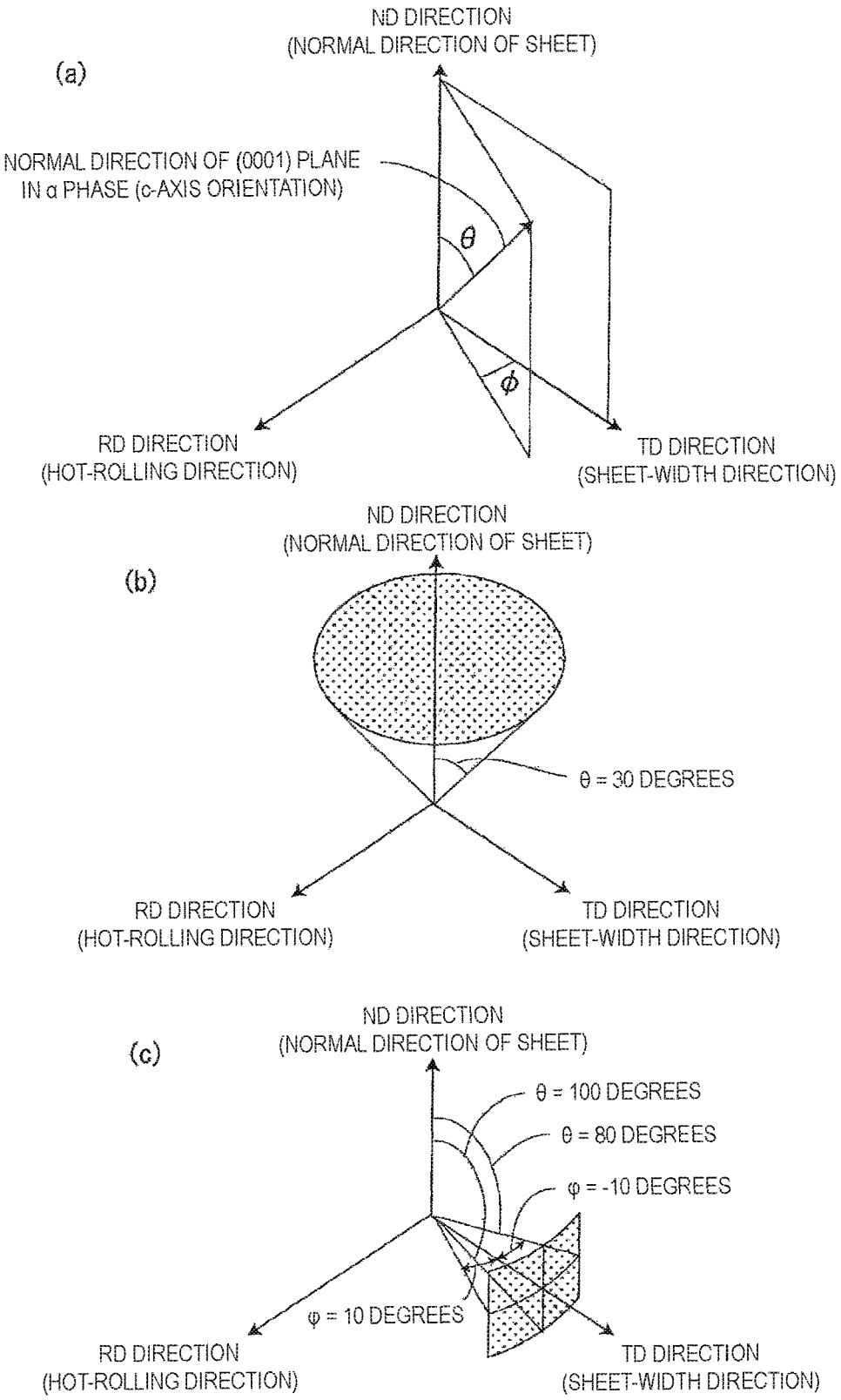
FIG. 1 is a diagram illustrating crystal orientations.

In order to solve the above-mentioned problems, the present inventors have investigated in detail effects of composition elements and a manufacturing method on material properties of a titanium alloy, and have found that an α+β titanium alloy having a high balance between strength and ductility, a high Young's modulus, and satisfactory hot workability can be manufactured by controlling addition amounts of Fe, Al, O, N, and Si. In particular, the inventors have found that high and uniform strength, a high Young's modulus, and high fatigue properties required for high-end golf club faces can be ensured by defining the addition amounts of O and N, which have functions of being solid-dissolved in and strengthening an α phase, within an appropriate range using $[O]_{eq}$ calculated by Expression (1), by adding Si in an appropriate amount, and by controlling appropriately the ratio of Si to O. Moreover, in the case where the alloy according to the present invention, which is strengthened by adding Al as a main element and adding O, N, and Si in combination, is manufactured into a sheet product, unidirectional hot-rolling or cold-rolling appropriately develops a texture which causes material anisotropy, and material anisotropy occurs where the Young's modulus and the strength in the sheet-width direction, that is, the direction perpendicular to the rolling direction, increase over those of the rolling direction. In addition, the alloy according to the present invention also has excellent fatigue properties and/or impact toughness.

At the surface of a golf club face, it is enough to realize the target values of the Young's modulus and the tensile strength in the vertical direction of the surface of the golf club face. Accordingly, it is sufficient to realize the Young's modulus and the tensile strength in at least one direction of the sheet. Here, as for a thin-sheet product, it becomes possible to realize the targets of the Young's modulus and the tensile strength in the sheet width direction by performing unidirectional rolling. That is, if making the vertical direction of the surface of the golf club face the sheet width direction, it is possible to obtain a high Young's modulus and tensile strength in the very direction required for a golf club face (vertical direction along the surface of golf club face). Moreover, bending fatigue properties in the case of performing bending deformation repeatedly in the sheet-width direction and Charpy impact properties in the case of providing notches in the sheet-width direction can also be improved.

The present invention has been made on the basis of the above findings. Hereinbelow, the reasons for selecting the constituent elements which are shown in the present invention and the ranges of amounts thereof will be shown. In the following description, unless otherwise mentioned, "%" represents "mass %.

Fe is an inexpensive constituent element among β stabilizer elements and has the ability of strengthening the β phase. In addition, since the β-stabilizing ability is high, Fe has the property of being able to stabilize the β phase even with a relatively low content. To obtain the strength necessary as a use as automobile parts or consumer products, for example, as a golf club face, more than or equal to 0.5% of Fe has to be contained. On the other hand, Fe tends to solidify and segregate in Ti, and, if added in a large amount, the volume fraction of the β phase with low Young's modulus compared to the α phase increases, so the Young's modulus of the bulk lowers, the Young's modulus in one direction in the plane of the sheet becomes less than 135 GPa, and it becomes difficult to clear the coefficient-of-restitution regulation in the case of being used as a golf club face. Further, the strength increases with the increase in the Fe content, and as a result, it is also found that the impact toughness decreases. Considering those effects, the upper limit of the Fe content is set to 1.4%. Note that, in order to emphasize the strength properties and reliably clear the coefficient-of-restitution regulation with the lowering Young's modulus, the lower limit of the Fe content is desirably 0.7% and the upper limit thereof is desirably 1.2%.

Al is a stabilizer element for the titanium α phase, has a high solid-solution-strengthening ability, and is an inexpensive constituent element. To obtain the level of strength necessary to be able to secure excellent fatigue properties as a use as high-grade golf club faces by containing later-described O and N in combination, that is, a tensile strength of more than or equal to 1100 MPa or more in the sheet-width direction of the thin-sheet product, the lower limit of the content is set to 4.7%. On the other hand, in the case where the Al content exceeds 5.5%, the increase in hot deformation resistance causes the hot workability to be deteriorated, the solidification segregation and the like excessively solid-solution-strengthen the α phase to generate locally hard regions, the fatigue strength decreases, and the impact toughness also decreases. Therefore, it is necessary that the Al content be less than or equal to 5.5%.

Both O and N each interstitially solid-dissolve in the α phase and each have a function of solid-solution-strengthening the α phase near room temperature. Being contained in combination with Al, it becomes possible to achieve high strength and a high Young's modulus. On the other hand, unlike Al, O and N do not cause the hot deformation resistance to increase, so O, N, and Si being contained in combination enables the Al content to be suppressed. As described in Patent Literatures 4 to 6, owing to the similarly of the strengthening mechanisms of O and N on Ti, the actions of O and N on the strength at room temperature can be uniquely expressed by $[O]_{eq}$ which is shown in the above Expression (1). Also in the case where Si is contained, with O and N being contained with $[O]_{eq}$ of less than 0.13%, it is not possible to stably obtain strength in which sufficient fatigue properties are expressed as a high-grade golf club face, for example, that is, for a thin-sheet product, a tensile strength of more than or equal to 1100 MPa in one direction in the plane of the plane. In Patent Literature 7, the lower limit of O alone is 0.08%, and it can be found that it is not an object to obtain sufficient strength. Further, with Si being contained in combination, with O and N being contained in a range that $[O]_{eq}$ is more than or equal to 0.25%, excessive solid-solution-strengthening of the α phase owing to solidification segregation generates locally hard regions, and the fatigue strength and/or impact toughness decrease/decreases. Therefore, it is necessary that the lower limit of $[O]_{eq}$ shown in Expression (1) be more than or equal to 0.13% and the upper limit thereof be less than 0.25%, and it is necessary that Si/O be controlled appropriately in order to achieve strength uniformity.

Regarding the N content, in the case where more than 0.030% of N is contained by a normal method of using titanium sponge containing a high concentration of N, undissolved inclusions called low density inclusions (LDI's) are likely to be generated and the production yield decreases, therefore, the upper limit is set to 0.030%. N is not necessarily contained.

Si is a stabilizer element for the titanium β phase, but also solid-dissolves in the α phase and has a high solid-solution-strengthening ability, and is an inexpensive constituent element. To obtain the level of strength necessary to secure the fatigue properties as a high-grade golf club face by containing O and N in combination, that is, a tensile strength of more than or equal to 1100 MPa in the sheet-width direction of the thin-sheet product, the lower limit of the content is set to 0.15%. It is preferably more than or equal to 0.25%. Further, since Si has an opposite segregation tendency to O, high fatigue strength and high and uniform tensile strength can be achieved by Si and O being contained in combination in appropriate amounts. This is a feature of effects obtained by containing Si. Here, in Patent Literatures 6 and 7, with components similar to the present invention, the Si content is defined to less than 0.25% from the viewpoint of decrease in fatigue strength. However, even if the Si content is more than or equal to 0.25%, a segregated portion containing locally highly concentrated Si or coarse silicide is not generated, decrease in the fatigue properties does not occur, and in the case where the O content is high, it is not possible to obtain uniform strength. Further, it has also been found that, in the case where Si is more than or equal to 0.2%, the impact toughness also increases. That is, in a region having a composition of more than or equal to 0.2% of Si, more satisfactory fatigue properties and excellent impact toughness can be obtained. On the other hand, in the case where the Si content exceeds 0.40%, coarse silicide is generated during hot-rolling or hot forging, or during cooling, which lowers the strength and is also likely to be a starting point of fatigue fracture. Therefore, sufficient fatigue properties as golf club faces, some automobile parts, and the like cannot be obtained, and the impact toughness also decreases. Moreover, Si has a function of increasing the hot deformation resistance, and in the case where the Si content exceeds 0.40%, the hot deformation resistance increases rapidly, and the hot workability decreases. Accordingly, it is necessary that the Si content be less than or equal to 0.40%. Regarding effects of Si on the impact toughness, in the case where the content exceeds 0.40%, the impact toughness deteriorates, and in the case where the content is less than 0.2%, there is no effect. In the case where the Si content is in the range of 0.2 to 0.40%, with increase in the content, the impact toughness increases.

Setting the ratio of Si/O to 0.80 to 2.80, uniform strength is achieved. This is because, by O and Si whose segregation tendencies in an ingot are opposite to each other being contained in combination, an effect of suppressing strength variation is obtained, and in addition thereto, by taking into account the ratio of solid-solution-strengthening abilities of the respective elements, strength variation at various portions of the ingot can be suppressed. The inventors have found that, on the basis of many experimental results, in the case where the Si content is the same as the O content, the solid-solution-strengthening ability of O is greater than the solid-solution-strengthening ability of Si. Accordingly, the inventors have found that the strength variation can be suppressed by setting the Si content to be greater than the O content. Here, in the case where Si/O is less than 0.80, effects of solid-solution-strengthening owing to O become too strong, and the strength increases at a region having a high O concentration. On the other hand, in the case where Si/O exceeds 2.80, effects of solid-solution-strengthening owing to Si become too strong, and the strength increases at a region having a high Si concentration. Therefore, the lower limit of Si/O is set to 0.80 and the upper limit thereof is set to 2.80.

In considering a use as a golf club face, in the case of manufacturing, as a material for the face, a thin-sheet product whose amount of working to form the face shape is small and which has little room for keeping down the coefficient of restitution by the face shape, if the transverse texture is developed, the tensile strength and the Young's modulus in the sheet-width direction become higher, so such thin-sheet product is preferable as the material for the face. In this case, as shown in FIG. 1(*a*), the normal direction of a rolling surface of a hot-rolled sheet is represented by an ND direction, a hot-rolling direction is represented by an RD direction, a sheet-width direction of the hot-rolled sheet is represented by a TD direction, the normal direction of a (0001) plane in an α phase is represented by a c-axis orientation, an angle between the c-axis orientation and the ND direction is represented by θ, and an angle between a plane including the c-axis orientation and the ND direction and a plane including the ND direction and the TD direction is represented by φ. Next, as shown in FIG. 1(*b*), XND represents the strongest intensity among X-ray (0002) reflection relative intensities of crystal grains in which the angle θ is more than or equal to 0 degree and less than or equal to 30 degrees and the angle (p is a whole circumference (−180 degrees to 180 degrees), and, as shown in FIG. 1(*c*), XTD represents the strongest intensity among X-ray (0002) reflection relative intensities of crystal grains in which the angle θ is more than or equal to 80 degrees and less than 100 degrees and the angle (p is within ±10 degrees. In the case where XTD/XND is more than or equal to 4.0, the tensile strength in the sheet-width direction satisfies 1100 MPa and the Young's modulus in the sheet-width direction satisfies 135 GPa, and hence, properties required for high-end model golf club faces can be cleared. Therefore, the range of XTD/XND is set to more than or equal to 4.0.

Regarding the titanium alloy having the above composition, there will be described an example of manufacturing conditions for developing the transverse-texture and increasing the strength and the Young's modulus in the sheet-width direction, which are required for the material for high-end model golf club faces. A titanium alloy slab having the above composition is heated to a hot-rolling heating temperature of higher than or equal to the β transus point−20° C. and lower than or equal to the β transus point+150° C., and then is subjected to unidirectional hot-rolling by setting a reduction in sheet thickness in an α+β region to more than or equal to 80% out of the total reduction in sheet thickness of more than or equal to 90% and by setting a hot-rolling finishing temperature to lower than or equal to the β transus point−50° C. and higher than or equal to the β transus point−250° C.

In order to turn the texture in the sheet plane direction of a hot-rolled sheet obtained after the hot-rolling step into a strong T-texture and to secure high material anisotropy, in the hot-rolling process, a slab having a predetermined composition is heated to the hot-rolling heating temperature in a β single-phase region and is held for, for example, more than or equal to 30 minutes, to thereby be once brought into a β single-phase state. Thereafter, from the hot-rolling heating temperature to the hot-rolling finishing temperature in a high-temperature region of an α+β dual-phase, it is necessary to perform the unidirectional hot-rolling to apply heavy reduction in sheet thickness in the α+β region of more than or equal to 80% out of the total reduction in sheet thickness of more than or equal to 90%.

Note that the β transus temperature can be measured by a differential thermal analysis. By use of test pieces that have been made by vacuum melting and forging ten or more kinds of materials each in a small amount of the laboratory level, where the chemical composition containing Fe, Al, N and O is changed within the range of the chemical composition to be made, the β/α transformation starting temperature and the transformation finishing temperature are previously examined by using a differential thermal analysis of gradually cooling each of the test pieces from the β single-phase region of 1150° C. Then, at the time of actual manufacture, whether the temperature is in the β single-phase region or in the α+β region can be determined on the spot by the chemical composition and successive temperature measurement with a radiation thermometer of the manufactured material. The hot-rolling temperature is measured with radiation thermometers each disposed between stands of a hot-rolling mill. Further, when the temperature of a material to be hot-rolled at the entrance of each stand is in the α+β two-phase region, it is determined that the material to be hot-rolled has been hot-rolled in the α+β two-phase region at the stand, and the rolling reduction at the stand is measured.

When the hot-rolling heating temperature is lower than the β transus point −20° C., namely is in the α+β dual-phase region, or further the hot-rolling finishing temperature is lower than the β transus point−250° C., β/α phase transformation often occurs during the hot-rolling and strong reduction is as a result applied in a state of the volume fraction of α phase being high. Consequently, the reduction performed in the β single-phase region or in a dual-phase region composed of high volume fraction of β phase becomes insufficient, so that the T-texture does not develop sufficiently. Further, when the hot-rolling finishing temperature becomes lower than the β transus point−250° C., the hot deformation resistance increases rapidly and the hot workability decreases, so that edge cracking and the like often occur to cause a problem of a decrease in production yield. Thus, it is necessary to set the lower limit of the hot-rolling heating temperature to the β transus and to set the lower limit of the hot-rolling finishing temperature to higher than or equal to the β transus point −250° C. In particular, the alloy of the present invention contains Si, and when the heating temperature is in the α+β dual-phase region that includes a small amount of β phase, Si concentrates in the β phase and locally segregates, or silicide is generated during cooling, which becomes a starting point of fatigue fracture to thereby deteriorate fatigue properties. The temperature which causes such a volume fraction of the β phase is lower than the β transus point−20° C., and therefore, it is necessary that the hot-rolling heating temperature be higher than or equal to the β transus point−20° C.

At this time, when the reduction in sheet thickness from the β single-phase region to the α+β dual-phase region (from the hot-rolling heating temperature to the hot-rolling finishing temperature) is less than 90%, strain introduced by hot-rolling is not sufficient and thus strain is not easily introduced throughout the whole sheet thickness uniformly. Therefore, the orientation of the β phase cannot be obtained throughout the whole sheet thickness and the T-texture does not sometimes develop. In particular, when the reduction in sheet thickness in the α+β region is less than 80%, the orientation of the β phase cannot be accumulated sufficiently and crystal orientations of the α phase to be generated by transformation are randomized partially. As a result, the T-texture does not develop to such an extent that high in-plane anisotropy in the sheet such that the bendability in the sheet longitudinal direction is improved to create superior pipe-making properties and the rigidity in the sheet-width direction, namely in the axial direction after pipe making increases. Thus, in the hot-rolling process, it is necessary that the reduction in sheet thickness be more than or equal to 90%, and the reduction in sheet thickness in the α+β region be more than or equal to 80%.

Further, when the hot-rolling heating temperature exceeds the β transus point+150° C., β grains become coarse rapidly. In this case, the hot-rolling is mostly performed in the β single-phase region, the coarse β grains are extended in the rolling direction, and therefrom, β/α phase transformation occurs, resulting in that the T-texture cannot develop easily. At the same time, the surface of the material for hot-rolling is heavily oxidized to cause a manufacturing problem such that scabs and scratches are likely to be formed on the surface of the hot-rolled sheet after the hot-rolling. Thus, as for the region of the hot-rolling heating temperature, the upper limit should be the β transus point+150° C. and the lower limit should be the β transus point.

On the other hand, when the hot-rolling finishing temperature at the hot-rolling exceeds the β transus point−50° C., most of the hot-rolling is performed in the β single-phase region and thereby an initial structure is composed of coarse β grains, so that strain is introduced in a non-uniform manner by hot-rolling due to crystal orientations of the β grains. Thereby, this cause a problem that orientation integration in the α phase after the β/α transformation is not sufficient and the α phase having random crystal orientations is partially generated, and thus the T-texture does not develop sufficiently. Thus, it is necessary that the upper limit of the hot-rolling finishing temperature be the β transus point−50° C. Therefore, it is necessary that the hot-rolling finishing temperature be in a temperature region of lower than or equal to the β transus point−50° C. and higher than or equal to the β transus point−250° C.

Further, in the hot-rolling process under the above-described conditions, the temperature is high compared to that of the heating and hot-rolling in the α+β region, which is one of the hot-rolling conditions for the α+β titanium alloy, so that a decrease in temperature at both edges of the sheet is suppressed. As above, there are advantages in that good hot workability is maintained even at the both edges of the sheet and occurrence of edge cracking is suppressed.

After finishing the hot-rolling, if cooling from the finishing temperature to 600° C. is performed at a low rate, silicide may be precipitated and the fatigue strength may be deteriorated. After finishing the hot-rolling, the cooling to 600° C. at a rate of more than or equal to 1° C./s can suppress the precipitation of silicide, and hence is set to a lower limit of the cooling rate.

The unidirectional hot-rolling, in which rolling is consistently performed only in one direction from the start to the end of the hot-rolling, is performed, because in the case where the sheet is formed into the shape of a pipe by being bent to manufacture the welded pipe and the sheet-width direction is set to the pipe longitudinal direction, the deformation resistance during bending is decreased and the bendability is improved, which are intended in the present invention, and the T-texture that makes the strength and the Young's modulus in the pipe longitudinal direction high is obtained efficiently. In this manner, a titanium alloy sheet for high-grade golf club faces can be obtained, in which uniform strength in the sheet-width direction exceeds 1100 MPa, the Young's modulus is as high as more than or equal to 135 GPa, and the fatigue properties and the impact toughness are excellent.

Here, having high fatigue properties is defined as follows: the fatigue strength after repeating a three-point bending fatigue test for 100 thousand times is more than or equal to 800 MPa.

Further, having high impact toughness is defined as follows: Charpy absorbed energy is 25 J/cm$^2$ or more.

In this manner, in the case where the titanium alloy thin-sheet having the high Young's modulus and the uniform strength is used for a material for a golf club face, by aligning the sheet-width direction with the vertical direction of the face or with a direction similar to the vertical direction of the face, the face can be manufactured, which meets the coefficient-of-restitution regulation and has high fatigue properties and excellent impact toughness.

EXAMPLES

Example 1

Titanium materials having chemical compositions shown in Table 1 were melted and hot-forged by a vacuum arc melting method into slabs each having a thickness of 180 mm. The slabs were heated to 1060° C., and the slabs other than Test Nos. 1 and 22 were unidirectionally hot-rolled, to manufacture hot-rolled sheets each having a thickness of 4 mm. The slabs of Test Nos. 1 and 22 were heated to 1060° C., and were subjected to cross rolling including hot-rolling in the sheet-width direction, to manufacture hot-rolled sheets each having a thickness of 4 mm. The hot-rolled sheets were subjected to shot blasting treatment, and then pickled to remove oxide scales.

In the event of removing oxide scales, depths of surface scratches were measured using a depth gauge to evaluate hot workability (A: maximum scratch depth ≤0.3 mm, B: maximum scratch depth >0.3 mm). The results thereof and the results obtained by investigating the tensile properties are shown in Table 1.

Figure 2:
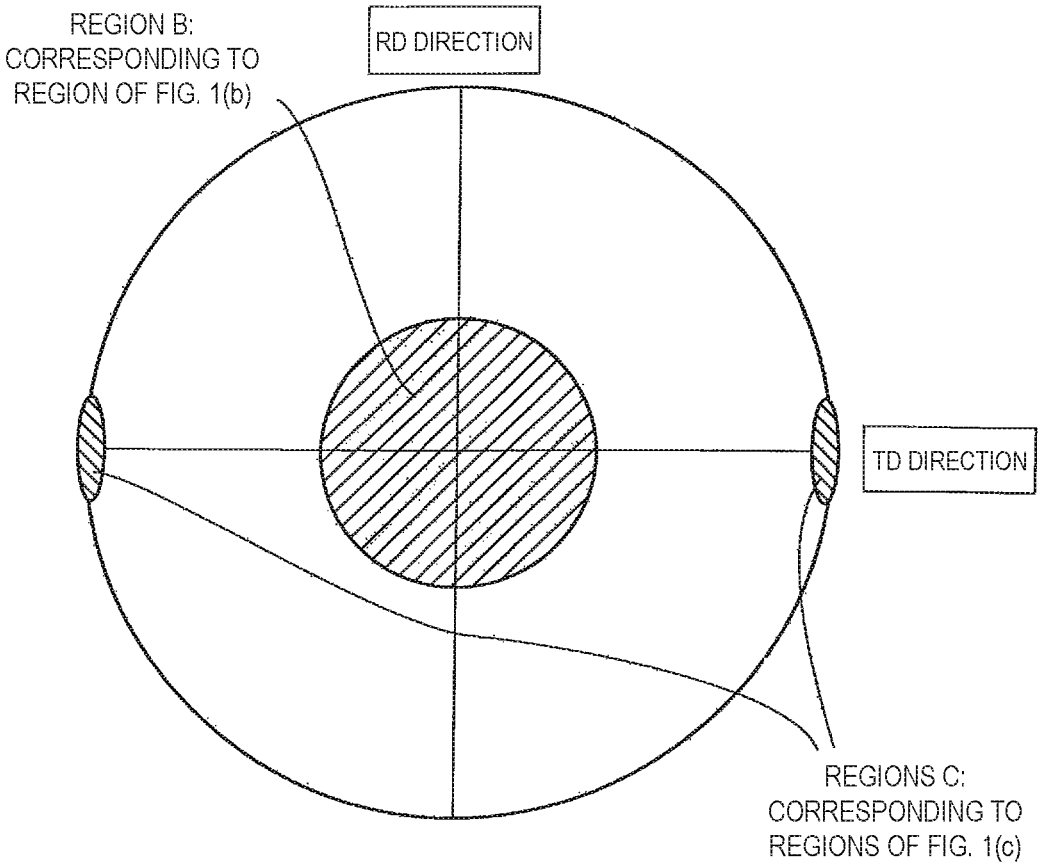
FIG. 2 is a diagram illustrating an X-ray pole figure.

Further, a texture in the sheet plane direction of the hot-rolled pickled sheet was measured by X-ray diffraction, and, in a (0001) plane pole figure of the α phase seen in the ND direction of the hot-rolling surface: as shown in a hatched part (region B) of FIG. 2, XND represents the strongest intensity among X-ray α phase (0002) reflection relative intensities of crystal grains in which the angle θ between the c-axis orientation and the ND direction is less than or equal to 30 degrees (region shown in FIG. 1(*b*)); as shown in hatched parts (regions C) of FIG. 2, XTD represents the strongest intensity among X-ray α phase (0002) reflection relative intensities of crystal grains in which the angle θ between the c-axis orientation and the ND direction is more than or equal to 80 degrees and less than 100 degrees and the angle φ is in the range within ±10 degrees (region shown in FIG. 1(*c*)); and the ratio of XTD/XND represents an X-ray anisotropy index, with which the degree of development of the texture was evaluated.

The table shows 100 thousand times-fatigue strength when the three-point bending fatigue test was carried out at room temperature. For a test piece for evaluating the fatigue properties, used was a piece obtained from the vicinity of the central part in the sheet thickness direction of the hot-rolled sheet and processed into sizes of t2.0 (mm)×w15 (mm)×L60 (mm) in which the sheet-width direction was set to the longitudinal direction to make the surface flat. The fatigue test was performed in a manner of three-point bending, by pushing a jig (punch) with a tip having a radius of curvature of 2 mm into the central part in the longitudinal direction of the test piece and thereby applying a repeated load at a frequency of 6 Hz at a stress ratio of 0.1 to the test piece. In other words, it was a repeated three-point bending fatigue test. The distances between the load point and the respective supporting points at both sides were each set to 20 mm. That is, the distance between the supporting points at both sides was 40 mm, and the punch applying a bending stress load was located midway between the supporting points. Here, the stress ratio is defined as a ratio of the minimum load stress on the test piece to the maximum load stress on the test piece. The stress applied to the test piece was determined by measuring an indentation load of the punch and also substituting sizes of the test piece in a deflection equation of the strength of materials. The strain caused by the bending may be determined from the equation of the strength of materials, or may be determined by attaching a strain gauge to a sample and actually measuring the strain generated in the longitudinal direction of the sample. The indentation amounts corresponding to the maximum stress and the minimum stress defines the upper limit and the lower limit, respectively, of the stroke of the punch. The load are repeatedly applied by the movement of the punch going up and down between the upper limit and the lower limit repeatedly. Performing the fatigue test at the stress ratio of 0.1 means that the ratio of the minimum stress to the maximum stress is 0.1. For example, in the case where the maximum stress is 800 MPa, the indentation load is adjusted such that the minimum stress is 80 MPa, and the stress is applied repeatedly. In the present invention, the 100 thousand times-fatigue strength ($10^5$ times-fatigue strength) is defined as a maximum load stress by which the fracture does not occur after application of load is repeated for $10^5$ times, and is characterized in that it maintains the value of more than or equal to 800 MPa. This shows that the fatigue properties is extremely high, and shows that high durability that is necessary for high-grade golf club faces is provided. On the contrary, in the case where the load is applied repeatedly at the maximum load stress of lower than or equal to 800 MPa, if the fracture occurred with the number of repeating times of less than or equal to $10^5$, it means that the fatigue properties that the present invention aims at are not satisfied. For the sample that did not fracture after the application of load was repeated for more than or equal to $10^5$ times, the load was applied repeatedly to a different test piece made of the same material with an increased maximum load stress, and if no fracture occurred after the application of load was repeated for $10^5$ times again, the load test was performed repeatedly on a new test piece with a further increased maximum load stress. The fatigue test was performed by repeating this process until the fracture occurred.

Further, comparing Test No. 18 shown in Table 1, which is a comparative example and does not contain Si, to Test No. 20 shown in Table 1, which is a present invention example and contains Si, the comparative example is inferior to the present invention example in the $10^5$ times-fatigue strength, and it is found that the effect of adding Si, O, and N in combination is exhibited, which is one of the characteristics of the present invention.

Moreover, a Charpy impact test piece (subsize: t2.5 (mm)×w10 (mm)×L55 (mm)) defined in JIS Z2242 was processed in the longitudinal direction of the hot-rolled sheet, a Charpy impact test was performed, and impact toughness was evaluated. The impact test piece was processed so as to have a V notch with a depth of 2 mm in a direction corresponding to the sheet-width direction of the original hot-rolled sheet. The Charpy impact test was performed at 22° C., and a value obtained by dividing the absorbed energy determined from the height at which the hammer was raised by a cross-sectional area of the test piece was evaluated as Charpy impact absorbed energy.

Further, the strength uniformity, which was deteriorated with local segregation of O and Si, was defined by a ratio ($HV^{max}/HV^{min}$) of a maximum value ($HV^{max}$) to a minimum value ($HV^{min}$) of micro-Vickers hardness among portions corresponding to the top portion, the middle portion, and the bottom portion of the ingot. In this case, the indentation load of the micro-Vickers hardness was set to 50 gf (HV of 0.05), and hardness values of a T-cross section were compared with each other. In this case, if the ratio of the maximum hardness to the minimum hardness was less than 1.15, the microhardness difference and the degree of strength ununiformity caused by solidification segregation of Si and O decreased, and hence, the decrease in the fatigue strength and/or the impact toughness could be suppressed.

TABLE 1

| Test No. | Al (mass %) | Fe (mass %) | V (mass %) | O (mass %) | N (mass %) | [O]eq (mass %) | Si (mass %) | Ti | Si/O | β transus point (° C.) | X-ray anisotropy index (XND/XTD) |
|---|---|---|---|---|---|---|---|---|---|---|---|
| 1 | 6.2 | — | 4.2 | 0.24 | 0.011 | 0.270 | — | bal. | — | 996 | 1.12 |
| 2 | 7.1 | 1.1 | — | 0.23 | 0.019 | 0.283 | — | " | — | 1052 | 5.56 |
| 3 | 3.8 | 1.2 | — | 0.18 | 0.005 | 0.194 | 0.32 | " | 1.778 | 978 | 8.48 |
| 4 | 5.0 | 1.2 | — | 0.18 | 0.005 | 0.194 | 0.32 | " | 1.778 | 1001 | 6.79 |
| 5 | 5.3 | 1.2 | — | 0.18 | 0.005 | 0.194 | 0.32 | " | 1.778 | 1007 | 6.74 |
| 6 | 6.7 | 1.2 | — | 0.18 | 0.005 | 0.194 | 0.32 | " | 1.778 | 1036 | 5.42 |
| 7 | 4.9 | 0.2 | — | 0.20 | 0.010 | 0.228 | 0.19 | " | 0.950 | 1023 | 6.01 |
| 8 | 4.9 | 0.7 | — | 0.20 | 0.010 | 0.228 | 0.19 | " | 0.950 | 1009 | 7.84 |
| 9 | 4.9 | 1.2 | — | 0.20 | 0.010 | 0.228 | 0.19 | " | 0.950 | 1002 | 7.16 |
| 10 | 4.9 | 1.9 | — | 0.20 | 0.010 | 0.228 | 0.19 | " | 0.950 | 989 | 8.69 |
| 11 | 5.2 | 1.0 | — | 0.08 | 0.008 | 0.102 | 0.37 | " | 4.625 | 997 | 9.01 |
| 12 | 5.2 | 1.0 | — | 0.14 | 0.008 | 0.162 | 0.37 | " | 2.643 | 1003 | 7.25 |
| 13 | 5.2 | 1.0 | — | 0.17 | 0.008 | 0.192 | 0.37 | " | 2.176 | 1008 | 6.78 |
| 14 | 5.2 | 1.0 | — | 0.27 | 0.008 | 0.292 | 0.37 | " | 1.370 | 1018 | 6.42 |
| 15 | 5.0 | 0.9 | — | 0.21 | 0.002 | 0.216 | 0.25 | " | 1.190 | 1010 | 6.34 |
| 16 | 5.0 | 0.9 | — | 0.21 | 0.008 | 0.232 | 0.25 | " | 1.190 | 1011 | 6.12 |
| 17 | 5.0 | 0.9 | — | 0.21 | 0.055 | 0.362 | 0.25 | " | 1.190 | 1017 | 4.58 |
| 18 | 4.9 | 1.1 | — | 0.17 | 0.012 | 0.203 | — | " | — | 1000 | 8.55 |
| 19 | 4.9 | 1.1 | — | 0.17 | 0.012 | 0.203 | 0.11 | " | 0.647 | 1000 | 8.49 |
| 20 | 4.9 | 1.1 | — | 0.17 | 0.012 | 0.203 | 0.34 | " | 2.000 | 996 | 9.13 |
| 21 | 4.9 | 1.2 | — | 0.17 | 0.012 | 0.203 | 0.49 | " | 2.882 | 992 | 9.02 |
| 22 | 4.9 | 1.1 | — | 0.16 | 0.021 | 0.218 | 0.23 | " | 1.438 | 1000 | 1.09 |
| 23 | 4.9 | 0.8 | — | 0.22 | 0.008 | 0.242 | 0.23 | " | 1.045 | 1011 | 5.68 |
| 24 | 5.3 | 1.2 | — | 0.15 | 0.004 | 0.161 | 0.35 | " | 2.333 | 1003 | 5.87 |
| 7A | 4.9 | 0.2 | — | 0.20 | 0.010 | 0.228 | 0.17 | " | 0.850 | 1023 | 5.98 |
| 8A | 4.9 | 0.7 | — | 0.20 | 0.010 | 0.228 | 0.17 | " | 0.850 | 1009 | 7.77 |
| 9A | 4.9 | 1.2 | — | 0.20 | 0.010 | 0.228 | 0.17 | " | 0.850 | 1002 | 7.19 |
| 10A | 4.9 | 1.9 | — | 0.20 | 0.010 | 0.228 | 0.17 | " | 0.850 | 989 | 8.88 |
| 25 | 5.3 | 1.2 | — | 0.28 | 0.004 | 0.291 | 0.01 | " | 0.036 | 1003 | 5.87 |

| Test No. | Tensile strength in sheet-width direction (MPa) | Young's modulus in sheet-width direction (GPa) | $10^5$ times-fatigue strength (MPa) | Charpy impact absorbed energy ($J/mm^2$) | Strength uniformity ($Hv^{max}/Hv^{min}$) | Hot-rolling scrach grade | Note |
|---|---|---|---|---|---|---|---|
| 1 | 1048 | 128 | 732 | 30.4 | 1.07 | B | Comparative Example |
| 2 | 1254 | 144 | 813 | 22.3 | 1.08 | B | Comparative Example |
| 3 | 1038 | 133 | 745 | 38.1 | 1.08 | A | Comparative Example |
| 4 | 1161 | 138 | 821 | 34.2 | 1.08 | A | Present Invention Example (Claims 1 and 2) |
| 5 | 1186 | 139 | 832 | 33.3 | 1.08 | A | Present Invention Example (Claims 1 and 2) |
| 6 | 1285 | 145 | 878 | 22.7 | 1.09 | B | Comparative Example |
| 7 | 1064 | 135 | 778 | 24.7 | 1.06 | A | Comparative Example (Fe below lower limit) |
| 8 | 1156 | 138 | 827 | 23.8 | 1.06 | A | Present Invention Example (Claim 1) |
| 9 | 1230 | 143 | 841 | 23.3 | 1.07 | A | Present Invention Example (Claim 1) |
| 10 | 1297 | 133 | 882 | 22.1 | 1.07 | A | Comparative Example |
| 11 | 1075 | 138 | 775 | 41.2 | 1.26 | A | Comparative Example |
| 12 | 1150 | 142 | 832 | 32.1 | 1.11 | A | Present Invention Example (Claims 1 and 2) |
| 13 | 1198 | 142 | 846 | 31.2 | 1.11 | A | Present Invention Example (Claims 1 and 2) |
| 14 | 1301 | 148 | 781 | 19.8 | 1.10 | A | Comparative Example |

TABLE 1-continued

| | | | | | | | |
|---|---|---|---|---|---|---|---|
| 15 | 1145 | 139 | 829 | 29.8 | 1.06 | A | Present Invention Example (Claims 1 and 2) |
| 16 | 1188 | 140 | 835 | 28.5 | 1.06 | A | Present Invention Example (Claims 1 and 2) |
| 17 | — | — | — | — | — | B | Comparative Example |
| 18 | 1113 | 138 | 764 | 23.7 | 1.18 | A | Comparative Example |
| 19 | 1132 | 139 | 772 | 24.6 | 1.17 | A | Comparative Example |
| 20 | 1179 | 140 | 830 | 36.2 | 1.11 | A | Present Invention Example (Claims 1 and 2) |
| 21 | 1251 | 143 | 759 | 22.8 | 1.21 | B | Comparative Example |
| 22 | 1061 | 131 | 774 | 30.4 | 1.04 | A | Comparative Example |
| 23 | 1245 | 143 | 868 | 30.2 | 1.07 | A | Present Invention Example (Claims 1 and 2) |
| 24 | 1153 | 139 | 824 | 32.7 | 1.09 | A | Present Invention Example (Claim 1) |
| 7A | 1061 | 135 | 775 | 24.2 | 1.06 | A | Comparative Example |
| 8A | 1152 | 137 | 820 | 23.1 | 1.07 | A | Present Invention Example (Claim 1) |
| 9A | 1222 | 144 | 839 | 22.7 | 1.08 | A | Present Invention Example (Claim 1) |
| 10A | 1289 | 132 | 883 | 21.7 | 1.08 | A | Comparative Example |
| 25 | 1291 | 139 | 831 | 24.1 | 1.23 | A | Comparative Example |

In Table 1, Test No. 1 represents a result obtained by subjecting a Ti-6% Al-4% V alloy to cross rolling including hot-rolling in the sheet-width direction, and Test No. 2 represents a result obtained by subjecting Ti-7% Al-1% Fe to unidirectional hot-rolling. In Test No. 1, XTD/XND was lower than 3.0, and the tensile strength in the sheet-width direction did not reach 1100 MPa. Further, in Test No. 2, XTD/XND exceeded 3.0, and the tensile strength (TS) in the sheet-width direction of more than or equal to 1100 MPa and the Young's modulus of more than or equal to 135 GPa were satisfied, however, the hot workability was poor, as scratches formed by the hot-rolling each having a depth of more than or equal to 0.5 mm were present, and the impact toughness was also low, as the Charpy impact absorbed energy was lower than 25 J/cm$^2$. The decrease in the impact toughness was caused because the Al content was high. Moreover, in each of Test Nos. 18 and 19, the Si content was lower than the content defined in the present invention, the Young's modulus of 135 GPa and the tensile strength of 1100 MPa were satisfied, and the hot-rollability was satisfactory, however, the $10^5$ times-fatigue strength was lower than 800 MPa and the fatigue properties were not sufficient. In addition, the impact toughness was also low.

On the other hand, Test Nos. 4, 5, 8, 9, 12, 13, 15, 16, 20, 23, and 24, which are Examples of the present invention, each had high tensile strength (TS) in the sheet-width direction of more than or equal to 1100 MPa and also exhibited high $10^5$ times-fatigue strength of more than 800 MPa. From those properties, they had excellent properties in the case of being used as a golf club face. Further, in each of Test Nos. 4, 5, 12, 13, 15, 16, 20, 23, and 24 whose Si content was more than or equal to 0.2%, the Charpy impact absorbed energy exceeded 25 J/cm$^2$. In particular, in each of Test No. 4, 5, 12, 13, 20, 23, and 24 in which Si was added in a large amount, the Charpy impact absorbed energy exceeded 30 J/mm$^2$ and the impact toughness was excellent.

On the other hand, in each of Test Nos. 3, 7, 7A, and 11, the tensile strength in the sheet-width direction was less than or equal to 1100 MPa and the strength was not sufficient to be used as a face. This was because Test Nos. 3, 7, 7A, and 11 had values of Al, Fe, Fe, and $[O]_{eq}$ which were lower than the lower limits of the present invention, respectively, and hence had insufficient solid-solution-strengthening abilities and low tensile strength.

Compared to the present invention example, Test No. 14 was lower in the $10^5$ times-fatigue strength, and was not provided with sufficient fatigue properties. Further, the Charpy impact absorbed energy was also low. This was because Test No. 14 had a value of $[O]_{eq}$ which exceeded the upper limit, and hence generated locally hard regions owing to solidification segregation of O, and the fatigue strength and the impact toughness decreased. Further, in Test No. 17, N was added in an amount exceeding the upper limit of the present invention, and since LDI generation was confirmed, the test was interrupted.

Further, in each of Test Nos. 6, 17, and 21, a large number of surface defects each having a depth exceeding 0.5 mm were generated. This was because: in each of Test Nos. 6 and 21, Al and Si which lower the hot workability were added in amounts exceeding the upper limits of the present invention, respectively, and hot-rolling scratches were generated; in Test No. 17, the excessive N content generated LDI and the substances near the surface were recognized as the defects; and, in Test No. 21, the excessive Si content generated a region in which Si was locally concentrated and hardened or precipitated coarse silicide, and during hot working, a void was generated/combined between a Si-segregated portion or silicide and a matrix to thereby form a surface defect. In Test No. 6, the Charpy impact absorbed energy was less than 25 J/cm$^2$, and the impact toughness was also low. This was because the amount of addition of Al was high and the strength was too high. Moreover, in Test No. 21, the $10^5$ times-fatigue strength was less than 800 MPa. The Charpy impact absorbed energy was less than 25 J/cm$^2$, and the impact toughness was also low. This was because those properties decreased due to the fact that a region in which Si was locally concentrated and hardened or coarse silicide acted as a starting point.

In each of Test Nos. 10 and 10A, the Fe content was too high and the Young's modulus was less than 135 GPa. Further, due to high strength, the impact toughness lowered.

Further, in Test No. 22, as a result of performing cross rolling including hot-rolling in the sheet-width direction, XTD/XND was less than 3.0, the tensile strength of 1100 MPa and the Young's modulus of 135 GPa were not obtained, and the fatigue strength was also low. This was because the transverse-texture was not developed by the cross rolling.

Further, in each of Test Nos. 8, 9, 8A, and 9A in which Si was added in an amount of more than or equal to 0.15% and less than 0.20%, other alloying elements were added in the ranges of the contents of the present invention, and XTD/XND had a value defined in the present invention, the $10^5$ times-fatigue strength was high, but the Charpy impact absorbed energy was slightly below 25 J/cm$^2$. This was because the Si content was sufficient for increasing the fatigue strength but was not sufficient for increasing the impact toughness.

Further, in the case where Test Nos. 11, 19, 21, and 25 were excluded, the others satisfied $HV^{max}/HV^{min}<1.15$, which shows that the strength is uniform. This was because Test Nos. 19 and 25 each had a Si/O value lower than the lower limit of the present invention, Test Nos. 11 and 21 each had a Si/O value higher than the upper limit of the present invention, and the others each had a Si/O value within the range of the present invention. Accordingly, in each of Test Nos. 11, 19, and 21, the fatigue strength was low, and in Test No. 25, the Charpy impact properties were low.

Consequently, the titanium alloy hot-rolled sheet having the contents of elements and XTD/XND defined in the present invention has high tensile strength and a high Young's modulus in the sheet-width direction, and hence has excellent material properties as a material for high-end golf club faces and satisfactory hot workability. On the other hand, in the case where the contents of elements are out of the contents defined in the present invention, the hot workability is deteriorated, and it is not possible to satisfy the material properties necessary for the golf club faces, such as the tensile strength, the Young's modulus, the fatigue strength and/or the impact toughness in the sheet-width direction.

In addition, comparison of the present invention material to a Ti—Al—V-based conventional material in popular use was performed. An alloy obtained by using Ti-6% Al-4% V as a base composition and adding oxygen whose amount is varied is a titanium alloy that is used widely, and the strength (tensile strength) thereof can be adjusted in accordance with the amount of addition of oxygen. Accordingly, to Ti-6% Al-4% V having a strength of approximately 1000 MPa, oxygen is added such that the strength is adjusted to approximately 1100 to 1200 MPa to thereby manufacture an alloy having a strength approximately the same as the strength of the alloy according to the present invention, and the fatigue properties of the alloy were compared to the fatigue properties of the alloy of the present invention having the approximately the same strength. The Ti-6% Al-4% V conventional material often cracked during hot-rolling, the $10^5$ times-fatigue strength in every sample was lower than the $10^5$ times-fatigue strength of the alloy of the present invention, and thus, the conventional material was inferior.

Example 2

Titanium materials having chemical compositions shown in Test Nos. 5 and 9 in Table 1 were melted and hot-forged by a vacuum arc melting method into slabs each having a thickness of 180 mm. The slabs were were unidirectionally hot-rolled under the conditions shown in Tables 2 and 3, to manufacture hot-rolled sheets each having a thickness of 4 mm. The hot-rolled sheets were subjected to shot blasting treatment, and then pickled to remove oxide scales.

In the event of removing oxide scales, depths of surface scratches were measured using a depth gauge to evaluate hot workability (A: maximum scratch depth ≤0.3 mm, B: maximum scratch depth >0.3 mm). The results thereof and the results obtained by investigating the tensile properties are shown in Tables 2 and 3.

Further, a texture in the sheet plane direction of the hot-rolled pickled sheet was measured by X-ray diffraction, and, in a (0001) plane pole figure of the α phase seen from the ND direction of the hot-rolling surface: as shown in a hatched part (region B) of FIG. 2, XND represents the strongest intensity among X-ray α phase (0002) reflection relative intensities of crystal grains in which the angle θ between the c-axis orientation and the ND direction is less than or equal to 30 degrees; as shown in hatched parts (regions C) of FIG. 2, XTD represents the strongest intensity among X-ray α phase (0002) reflection relative intensities of crystal grains in which the angle θ between the c-axis orientation and the ND direction is more than or equal to 80 degrees and less than 100 degrees and the angle φ is in the range within ±10 degrees; and the ratio of XTD/XND represents an X-ray anisotropy index, with which the degree of development of the texture was evaluated.

Further, the tables show $10^5$ times-fatigue strength when the three-point bending fatigue test was carried out at room temperature. Used for a test piece was a piece obtained from the vicinity of the central part in the sheet thickness direction of the hot-rolled sheet and processed into sizes of t2.0 (mm)×w15 (mm)×L60 (mm) in which the sheet-width direction was set to the longitudinal direction to make the surface flat. The fatigue test was performed by pushing a jig with a tip having a radius of curvature of 2 mm into the center in the longitudinal direction of the test piece and thereby applying a repeated load at a frequency of 6 Hz at a stress ratio of 0.1 to the test piece. The distances between the load point and the respective supporting points at both sides were each set to 20 mm. The $10^5$ times-fatigue strength was more than or equal to 800 MPa and the fatigue strength was sufficiently high, and thus, excellent fatigue properties were obtained.

TABLE 2

| Test No. | Total reduction in sheet thickness (%) | Reduction in sheet thickness in α + β region (%) | Hot-rolling heating temperature (° C.) | Hot-rolling finishing temperature (° C.) | Cooling rate from finishing temperature to 600° C. (° C./s) | X-ray anisotropy index (XND/XTD) | Tensile strength in sheet-width direction (MPa) | Young's modulus in sheet-width direction (GPa) | $10^5$ times-fatigue strength (MPa) | Hot-rolling scrach grade |
|---|---|---|---|---|---|---|---|---|---|---|
| 25 | 92.0 | 92.0 | 945 | 725 | 5.3 | 2.68 | 1078 | 133 | 789 | B |
| 26 | 96.5 | 90.2 | 990 | 809 | 2.8 | 4.56 | 1110 | 139 | 819 | A |
| 27 | 91.9 | 86.5 | 1020 | 834 | 20.1 | 6.76 | 1148 | 141 | 823 | A |
| 28 | 94.5 | 83.9 | 1045 | 876 | 10.3 | 6.84 | 1159 | 141 | 826 | A |
| 29 | 95.1 | 81.3 | 1100 | 902 | 22.3 | 5.42 | 1116 | 139 | 821 | A |
| 29A | 80.5 | 72.4 | 1040 | 812 | 4.1 | 4.11 | 1066 | 131 | 771 | A |

TABLE 2-continued

| Test No. | Total reduction in sheet thickness (%) | Reduction in sheet thickness in α + β region (%) | Hot-rolling heating temperature (° C.) | Hot-rolling finishing temperature (° C.) | Cooling rate from finishing temperature to 600° C. (° C./s) | X-ray anisotropy index (XND/XTD) | Tensile strength in sheet-width direction (MPa) | Young's modulus in sheet-width direction (GPa) | $10^5$ times-fatigue strength (MPa) | Hot-rolling scrach grade |
|---|---|---|---|---|---|---|---|---|---|---|
| 29B | 91.2 | 73.8 | 1120 | 876 | 15.8 | 3.56 | 1051 | 129 | 743 | A |
| 29C | 97.4 | 81.2 | 1190 | 878 | 6.2 | 3.11 | 1047 | 130 | 780 | A |
| 29D | 95.7 | 89.9 | 1070 | 840 | 0.1 | 15.6 | 1187 | 141 | 714 | A |

Transformation point: 1007° C.
Hot-rolling scrach grade
A: Maximum scratch depth ≤ 0.3 mm
B: Maximum scratch depth > 0.3 mm

TABLE 3

| Test No. | Total reduction in sheet thickness (%) | Reduction in sheet thickness in α + β region (%) | Hot-rolling heating temperature (° C.) | Hot-rolling finishing temperature (° C.) | Cooling rate from finishing temperature to 600° C. (° C./s) | X-ray anisotropy index (XND/XTD) | Tensile strength in sheet-width direction (MPa) | Young's modulus in sheet-width direction (GPa) | $10^5$ times-fatigue strength ratio*1 | Hot-rolling scrach grade |
|---|---|---|---|---|---|---|---|---|---|---|
| 30 | 91.1 | 91.1 | 925 | 718 | 3.2 | 2.15 | 1085 | 134 | 792 | B |
| 31 | 95.6 | 95.6 | 995 | 811 | 6.7 | 5.64 | 1137 | 140 | 822 | A |
| 32 | 93.8 | 87.2 | 1010 | 854 | 13.9 | 8.72 | 1197 | 144 | 831 | A |
| 33 | 95.4 | 86.4 | 1065 | 878 | 20.1 | 9.43 | 1221 | 144 | 838 | A |
| 34 | 96.9 | 82.4 | 1095 | 903 | 8.7 | 6.13 | 1145 | 141 | 824 | A |
| 34A | 81.9 | 72.8 | 1020 | 824 | 15.2 | 4.32 | 1042 | 130 | 765 | A |
| 34B | 90.9 | 76.1 | 1110 | 897 | 10.3 | 3.96 | 1038 | 129 | 755 | A |
| 34C | 97.9 | 80.9 | 1200 | 912 | 14.8 | 3.24 | 1067 | 131 | 777 | A |
| 34D | 95.9 | 90.7 | 1065 | 832 | 0.2 | 10.9 | 1178 | 140 | 722 | A |

Transformation point: 1002° C.
Hot-rolling scrach grade
A: Maximum scratch depth ≤ 0.3 mm
B: Maximum scratch depth > 0.3 mm
*1 $10^5$ times-fatigue strength ratio is a ratio of $10^5$ times-fatigue strength to $10^5$ times-fatigue strength of Ti—6%Al—4%V hot-rolled sheet having the same strength.

Tables 2 and 3 show results obtained by subjecting sheet products having chemical compositions shown in Test Nos. 5 and 9 of Table 1, respectively, to unidirectional hot-rolling. Of those, in each of the sheets manufactured under the conditions of Test Nos. 26, 27, 28, 29, 31, 32, 33, and 34, the heating temperature before the hot-rolling was in a β single-phase region (higher than or equal to the β transus temperature) or in an α+β dual-phase temperature region of immediately below the β transus point (down to the temperature 20° C. lower than the β transus point), and therefore, the transverse-texture developed, the tensile strength (more than or equal to 1100 MPa) and the Young's modulus (more than or equal to 135 GPa) in the sheet-width direction were sufficiently satisfied, and the fatigue strength was also high. In the case where those sheet materials were used as golf club faces, properties that meet the coefficient-of-restitution regulation and excellent fatigue properties were obtained. Further, those hot-rolled pickled sheets had no surface defect whose depth is more than 0.3 mm, and thus showed satisfactory hot-rollability. Therefore, those thin-sheet materials were suitable as a material for golf club faces.

On the other hand, in each of the hot-rolled sheets shown in Test Nos. 25, 29A, 29B, 29C, 29D, 30, 34A, 34B, 34C, and 34D, XTD/XND is less than or equal to 3.0, the tensile strength in the sheet-width direction was less than or equal to 1100 MPa, and the Young's modulus in the sheet-width direction was less than or equal to 135 GPa, and hence, those hot-rolled sheets were not suitable as materials, for example, for high-end golf club faces. This was because: in each of Test Nos. 25 and 30, since the heating temperature before the hot-rolling was relatively low in the α+β dual-phase region, the development of the transverse-texture was smaller compared when heating was performed up to the β single-phase region (higher than or equal to the β transus temperature) or to the α+β dual-phase temperature of the β transus point−20° C., and the material anisotropy did not become high; in each of Test Nos. 29A and 34A, since the total reduction in sheet thickness was less than 90%, the transverse-texture did not develop; in each of Test Nos. 29B and 34B, the reduction in sheet thickness in the α+β dual-phase region was less than 80%, the transverse-texture did not develop; in each of Test Nos. 29C and 34C, since the hot-rolling heating temperature was higher than the β transus point+150° C., coarse β grains were generated during heating, and the texture did not develop; and in each of Test Nos. 29D and 34D, since the cooling rate from the hot-rolling finishing temperature to 600° C. was less than 1° C./s, silicide precipitated and became a starting point of fatigue fracture. Moreover, in each of Test Nos. 25 and 30, a large number of hot-rolling scratches each having a depth of more than or equal to 0.3 mm were generated, and the hot-rolling scratch grade was low. This was because, in each of Test Nos. 25 and 30, since the hot-rolling finishing temperature was as low as lower than the β transus point−200° C., the hot deformability was low.

Consequently, in order to obtain a titanium alloy having a high Young's modulus and high tensile strength in the sheet-width direction, and excellent fatigue properties and/or impact toughness, it can be manufactured by heating the titanium alloy containing the elements in the composition range shown in the present invention to the temperature range of higher than or equal to the β transus point or immediately below the β transus point and performing unidirectional hot-rolling. The titanium alloy can be used for a wide range of application that requires high specific strength or fatigue properties, and particularly has excellent properties for being used as golf club faces or automobile parts.

Using the slab used for the hot-rolled sheet of Test No. 12, some hot-rolled sheets each having a hot-rolling ratio of less than 90% were manufactured, none of them could obtain the transverse-texture that was developed to an extent enough for achieving the strength, the Young's modulus, the fatigue properties, or the impact toughness that the present invention aims at. Here, the rolling ratio (%) is defined as "100×(sheet thickness before rolling−sheet thickness after rolling)/sheet thickness before rolling".

INDUSTRIAL APPLICABILITY

The titanium alloy according to the present invention has the Young's modulus of more than or equal to 135 GPa and the tensile strength of more than or equal to 1100 MPa in one direction in the sheet plane of the thin-sheet product, and is excellent in fatigue properties and/or impact toughness. Further, the titanium alloy also has satisfactory hot workability. This alloy has excellent fatigue properties and also satisfies the coefficient-of-restitution regulation. For example, the alloy can be provided as a material suitable for the use as high-grade golf club faces or automobile parts.

The invention claimed is:

1. An α+β titanium alloy hot-rolled sheet, the α+β titanium alloy hot-rolled sheet consisting of, in mass %, Al: 4.7 to 5.5%, Fe: 0.5 to 1.2%, N: less than or equal to 0.03%, $[O]_{eq}$ calculated using Expression (1): more than or equal to 0.13% and less than 0.25%, Si: 0.15 to 0.40%, a ratio of Si/O: 0.80 to 2.80, and the balance: Ti and impurities, wherein, in a case where an ND direction represents a normal direction of a rolling surface of the hot-rolled sheet, an RD direction represents a hot-rolling direction of the hot-rolled sheet, a TD direction represents a sheet-width direction of the hot-rolled sheet, a c-axis orientation represents a normal direction of a (0001) plane in an α phase, θ represents an angle between the c-axis orientation and the ND direction, φ represents an angle between a plane including the c-axis orientation and the ND direction and a plane including the ND direction and the TD direction, XND represents a strongest intensity among X-ray (0002) reflection relative intensities of crystal grains in which the angle θ is more than or equal to 0 degree and less than or equal to 30 degrees and the angle φ is a whole circumference (−180 degrees to 180 degrees), and XTD represents a strongest intensity among X-ray (0002) reflection relative intensities of crystal grains in which the angle θ is more than or equal to 80 degrees and less than 100 degrees and the angle φ is within ±10 degrees, $HV^{max}$ and $HV^{min}$ is a maximum value and a minimum value of hardness values of a T-cross section of micro-Vickers hardness among portions of the sheet corresponding to the top portion, the middle portion, and the bottom portion of the ingot, where an indentation load of the micro-Vickers hardness is set to 50 gf (HV of 0.05), XTD/XND is more than or equal to 4.0, a Young's modulus in the sheet-width direction is more than or equal to 135 GPa, and tensile strength in the sheet-width direction is more than or equal to 1100 MPa, $HV^{max}/HV^{min}$ is less than 1.15, where the sheet-width direction represents a direction perpendicular to the hot-rolling direction in a plane of the sheet, $$[O]_{eq}=[O]+2.77[N] \quad \text{Expression (1)}$$

where [O] represents an oxygen concentration (mass %) and [N] represents a nitrogen concentration (mass %).

2. An α+β titanium alloy hot-rolled sheet, the α+β titanium alloy hot-rolled sheet consisting of, in mass %, Al: 4.7 to 5.5%, Fe: 0.5 to 1.2%, N: less than or equal to 0.03%, $[O]_{eq}$ calculated using Expression (1): more than or equal to 0.13% and less than 0.25%, Si: 0.2 to 0.40%, a ratio of Si/O: 0.80 to 2.80, and the balance: Ti and impurities, wherein, in a case where an ND direction represents a normal direction of a rolling surface of the hot-rolled sheet, an RD direction represents a hot-rolling direction of the hot-rolled sheet, a TD direction represents a sheet-width direction of the hot-rolled sheet, a c-axis orientation represents a normal direction of a (0001) plane in an α phase, θ represents an angle between the c-axis orientation and the ND direction, φ represents an angle between a plane including the c-axis orientation and the ND direction and a plane including the ND direction and the TD direction, XND represents a strongest intensity among X-ray (0002) reflection relative intensities of crystal grains in which the angle θ is more than or equal to 0 degree and less than or equal to 30 degrees and the angle φ is a whole circumference (−180 degrees to 180 degrees), and XTD represents a strongest intensity among X-ray (0002) reflection relative intensities of crystal grains in which the angle θ is more than or equal to 80 degrees and less than 100 degrees and the angle φ is within ±10 degrees, $HV^{max}$ and $HV^{min}$ is a maximum value and a minimum value of hardness values of a T-cross section of micro-Vickers hardness among portions of the sheet corresponding to the top portion, the middle portion, and the bottom portion of the ingot, where an indentation load of the micro-Vickers hardness is set to 50 gf (HV of 0.05), XTD/XND is more than or equal to 4.0, a Young's modulus in the sheet-width direction is more than or equal to 135 GPa, and tensile strength in the sheet-width direction is more than or equal to 1100 MPa, $HV^{max}/HV^{min}$ is less than 1.15, where the sheet-width direction represents a direction perpendicular to the hot-rolling direction in a plane of the sheet, $$[O]_{eq}=[O]+2.77[N] \quad \text{Expression (1)}$$

where [O] represents an oxygen concentration (mass %) and [N] represents a nitrogen concentration (mass %).

* * * * *